US008734180B2

(12) United States Patent
Derks

(10) Patent No.: US 8,734,180 B2
(45) Date of Patent: May 27, 2014

(54) CONNECTING TERMINAL WITH CUTTING MEANS FOR AN ELECTRIC LINE

(75) Inventor: Henricus Derks, Schijndel (NL)

(73) Assignee: TE Connectivity Nederland B.V., 'S-Hertogenbosch (NL)

( * ) Notice: Subject to any disclaimer, the term of this patent is extended or adjusted under 35 U.S.C. 154(b) by 38 days.

(21) Appl. No.: 13/640,311

(22) PCT Filed: Apr. 4, 2011

(86) PCT No.: PCT/EP2011/055175
§ 371 (c)(1),
(2), (4) Date: Oct. 9, 2012

(87) PCT Pub. No.: WO2011/124544
PCT Pub. Date: Oct. 13, 2011

(65) Prior Publication Data

US 2013/0029519 A1 Jan. 31, 2013

(30) Foreign Application Priority Data

Apr. 10, 2010 (DE) ..... 10 2010 014 615

(51) Int. Cl.
*H01R 4/24* (2006.01)

(52) U.S. Cl.
USPC ..... 439/395

(58) Field of Classification Search
USPC ..... 439/392–398, 404–413
See application file for complete search history.

(56) References Cited

U.S. PATENT DOCUMENTS 4,127,312 A 11/1978 Fleischhacker
4,130,333 A * 12/1978 Djurinec ..... 439/418
4,162,815 A 7/1979 Fleischhacker (Continued)

FOREIGN PATENT DOCUMENTS

EP 0095307 A1 11/1983
EP 0991139 A1 4/2000
NL 7611299 A 5/1977
WO WO 2008/014081 A1 1/2008

OTHER PUBLICATIONS

International Search Report and Written Opinion Issued by the European Patent Office, dated May 12, 2011, for related International Application No. PCT/EP2011/055175; 9 pages.

(Continued)

*Primary Examiner* — Chandrika Prasad
(74) *Attorney, Agent, or Firm* — Fargre Baker Daniels LLP

(57) ABSTRACT

The invention relates to a connecting terminal (1) for at least one electric line (6). The connecting terminal has a housing (9), a line receptacle (2) extending in a direction of the line (L) through the housing, and a cutting means (20). The cutting means (20) comprises a blade pocket (48) extending transversely to the direction of the line (L) and limited in the direction of the line by at least one stripping jaw (50) which is deflectable in the direction of the line, and a severing knife (38) oriented with its cutting edge (40) towards the blade pocket. The severing knife (38) and the blade pocket (48) are arranged to be movable relative to each other from a starting position (14) into a severing position (18). In the severing position, the severing knife at least virtually completely blocks off the line receptacle, and is received, at least in sections, in the blade pocket. This configuration makes it possible to sever the electric line cleanly at any point whatsoever by means of the connecting terminal.

20 Claims, 4 Drawing Sheets

(56) References Cited

U.S. PATENT DOCUMENTS

| | | | | |
|---|---|---|---|---|
| 4,223,972 | A * | 9/1980 | Olsen | 439/387 |
| 4,552,429 | A | 11/1985 | van Alst | |
| 5,295,857 | A * | 3/1994 | Toly | 439/395 |
| 5,525,078 | A * | 6/1996 | Springer | 439/607.38 |
| 6,146,186 | A * | 11/2000 | Barrat et al. | 439/410 |
| 6,361,352 | B2 * | 3/2002 | Barrat et al. | 439/395 |
| 2001/0014552 | A1 * | 8/2001 | Barrat et al. | 439/406 |

OTHER PUBLICATIONS

International Preliminary Report on Patentability, issued by the International Bureau of WIPO, Geneva, Switzerland, dated Oct. 16, 2012, for related International Application No. PCT/EP2011/055175; 4 pages.

* cited by examiner

CONNECTING TERMINAL WITH CUTTING MEANS FOR AN ELECTRIC LINE

The invention relates to a connecting terminal for at least one electric line.

For example, a connecting terminal is known from U.S. Pat. No. 7,121,871 B2 which can be applied at any point whatsoever on a continuous cable and permits the contacting thereof. For this, the connecting terminal is placed around the line and an insulation-displacement contact, which cuts through the insulation of the line and brings about a displacement contact with the conductors of the line, is actuated. The device of U.S. Pat. No. 7,121,871 B2 does not permit electrical equipment to be connected in series to the continuous electric line. Such a necessity arises, for example, if electric circuits or items of equipment have to be looped in at a given point on a cable which is already present.

The cutting-in of an item of electrical equipment requires the electric line to be severed between the contact points for the equipment or the circuit. Further, there must no longer be any electrical contact between the two severed conductor ends. Such complete severing of an electric line at any point whatsoever is, however, not without problems, since fine strands or very elastic lines can be severed only with difficulty.

It is therefore the object of the invention to provide a connecting terminal with which an electric line, preferably at any point whatsoever, can be severed completely, simply and without the risk of short-circuits.

This object is achieved according to the invention by a connecting terminal for at least one electric line, with a housing, with a line receptacle extending in a direction of the line through the housing, and with a cutting means which has a blade pocket extending transversely to the direction of the line and limited in the direction of the line by at least one stripping jaw which is deflectable in the direction of the line, and a severing knife oriented with its cutting edge towards the blade pocket, the severing knife and the blade pocket being arranged to be movable relative to each other from a starting position into a severing position, in which the severing knife at least virtually completely blocks off the line receptacle and is received, at least in sections, in the blade pocket.

This solution ensures that the severing knife cuts cleanly through the electric line. Since the severing knife is wider than the blade pocket, the line is automatically shorn off or stripped at the edges of the blade pocket. Due to the deflectable configuration of the stripping jaw, the forces required for severing are not unnecessarily increased for widening the blade pocket in the breadth direction. At the same time, the contact between the stripping jaw and the side face of the severing knife facing the stripping jaw ensures that the line is stripped and does not end up between the stripping jaw and the blade pocket.

In the severing position, finally according to the solution of the invention the severing knife blocks off the line receptacle at least virtually completely, so that the electric line is reliably severed. At the same time, the severing knife separates the two severed ends.

The solution according to the invention can be further improved by a number of configurations which are each advantageous per se, and which can be combined with each other in any manner whatsoever.

Thus, in one possible development of the invention, the maximum breadth, in the direction of the line, of the section of the severing knife which projects into the blade pocket in the severing position may be greater than the internal width in this direction of the blade pocket in the starting position. The at least one stripping jaw in this configuration, in the severing position, is deflected away from the severing knife in the direction of the line relative to the starting position and shields the blade pocket from the line receptacle.

In one further advantageous configuration, the blade pocket may be limited, on the two sides located in the direction of the line, by at least one stripping jaw which is designed to be deflectable away from the blade pocket in the direction of the line. Production-related inaccuracies in the position of the knife are compensated for due to the preferably elastically deflectable stripping jaws arranged on either side of the severing knife. The position of the pocket thus adapts more easily to the position of the knife than with only a single stripping jaw on one side located in the direction of the line. Furthermore, a clean cut is thus achieved on both sides of the severing knife.

In order to apply a counter-pressure to the cutting direction which is necessary for severing the electric line and is oriented from the severing knife towards the blade pocket, at least one holding-down means may be provided in the direction of the line spaced apart from the at least one stripping jaw on the side of the line receptacle thereof. The holding-down means may project towards the line receptacle and project over the stripping jaw in this direction, so that during the course of the severing operation it contacts the electric line chronologically before the at least one stripping jaw.

In order to limit the deflection of the stripping jaw in the direction away from the blade pocket, at least one stop may be provided spaced apart from the stripping jaw at least in the starting position in the direction of the line. The at least one stop prevents the stripping jaw from being deflected too greatly and breaking off. Further, due to the stop only a limited amount of material, possibly containing strands, of the line which is to be severed may pass into the blade pocket between the severing knife and the at least one stripping jaw.

Preferably the distance between the stop and the at least one stripping jaw is approximately the excess width or, if at least one stripping jaw in each case is provided in each case on both sides of the blade pocket which are located in the direction of the line, corresponds to half of the excess width of the severing knife relative to the blade pocket, measured in each case in the direction of the line. These dimensions ensure that in the completely deflected state of the at least one stripping jaw, in which said jaw lies against the stop, no material of the electric line can pass between the severing knife and the stripping jaw and pass into the blade pocket. The stop may be located in particular on the holding-down means, which simplifies the construction of the connecting terminal.

The severing knife may be manufactured completely from an electrically non-conductive material. For reasons of cost, provision may however be made for the severing knife to have a severing base made from an electrically non-conductive material, such as an injection-mouldable plastics material, and a severing blade projecting over the severing base towards the blade pocket, which blade may also be made from an electrically conductive material, for example a stamped sheet.

In order to ensure, once the electric line has been severed, that there are no connections between the separated line ends in the region of the severing point, with this configuration the severing base in the severing position may at least virtually completely cover the cross-sectional surface of the line receptacle. Thus the severing base pushes between the two line ends like a partition and isolates them from each other. The severing blade in this case is preferably completely received in the blade pocket and the severing base may still likewise project into the blade pocket with one section. In order to protect the inertial bodies from accidental contacting, further the at least one stripping jaw in the severing position may lie deflected against the severing base. In the severing position, the conductive severing blade which has been moved into the blade pocket may be separated from the line receptacle by the at least one stripping jaw lying against the stop.

In order that complete separation of the two conductor ends takes place in the severing position, the height of the severing base transversely to the direction of the line and towards the blade pocket may correspond to at least the internal height of the line receptacle in this direction. Further, the breadth of the severing base transversely to the direction of the line and parallel to the blade pocket may correspond to at least the internal breadth of the line receptacle in this direction. The shape of the severing base in a plane transversely to the direction of the line may further correspond to the cross-sectional shape of the line receptacle. These measures result, individually or in combination, in the severing base completely blocking off the line receptacle. In order to facilitate the cutting operation and the penetration of the severing base into the blade pocket, according to a further configuration the severing base may taper towards the blade pocket.

Independently of this, the blade pocket may widen towards the severing knife at least in one run-in region, preferably around the opening of the blade pocket towards the severing knife. Both measures, independently of each other or in combination, result in less force being required for converting the connecting terminal into the severing position and deflecting the at least one stripping jaw.

According to a further advantageous configuration, the internal width of the blade pocket in the direction of the line may be less than the thickness of the severing blade in this direction, so that the stripping jaw is deflected already upon the severing blade penetrating into the blade pocket, and not only once the severing base penetrates. This results in an improved stripping operation and a cleaner cut.

The at least one stripping jaw and the severing knife may further be provided with complementary structures which change transversely to the direction of the line, which structures engage in one another, for example in rib-like, tooth-like or comb-like manner, in the severing position. The stripping jaw and the severing knife can be reinforced in the direction transversely to the direction of the line by means of such a structure. At the same time, such structures which move into each other may serve as guides which prevent tilting of the knife.

In order to prevent the stripping jaw from tilting relative to the plane of the severing knife and thus, at a point at which there is a relatively large gap between the stripping jaw and severing knife, material of the electric line from being able to enter the blade pocket and produce a short-circuit more easily, the at least one stripping jaw may have, on at least one side facing the blade pocket in the direction of the line, a plurality of stripping members lying next to one another transversely to the direction of the line. The stripping members may be designed to be deflectable independently of each other. The severing knife may have complementarily designed stripping members. In particular receptacles for the stripping jaws which lie next to one another may be provided on the severing knife, so that said jaws are guided in the direction transversely to their deflection. The stripping members of the at least one stripping jaw and of the severing knife may project towards each other somewhat relative to their immediate surroundings. The severing knife in this configuration is guided more accurately in the cutting plane provided by the design, the entire structure becomes more rigid and strips material better.

The interlocking or interleaving of the stripping jaws which lie next to one another with the associated receptacles on the severing-knife side results overall in a more stable and more highly loadable cutting means.

According to a further advantageous configuration, the housing may have at least two housing shells which can be assembled. The blade pocket and/or the stripping jaw may be attached to the one, and the severing knife to the other, housing shell. In the starting position, an insertion opening may be formed between the housing shells, which opening opens continuously in the direction of the line to the line receptacle and permits the line which is to be severed to be placed inside. This configuration permits the application of the connecting terminal at any point whatsoever on the electric line. The cutting means can be actuated and the electric line severed by assembling and pressing together the two housing shells. Preferably the two housing shells engage in each other in the severing position.

The connecting terminal may have at least one insulation-displacement contact in the direction of the line, spaced apart from the cutting means, which contact is connected in electrically conductive manner to a contact point which is accessible from outside the housing. Advantageously, such insulation-displacement contacts are provided on both sides of the cutting means. An item of electrical equipment may be connected to the contact points in series to the severed electric line.

The electric line may be part of a cable which comprises, at least in the region of the connecting terminal, a plurality of lines which lie next to one another. The cutting means may sever only one or alternatively a plurality of these lines. For this, one or more severing knives and blade pockets may be arranged lying next to each other.

The insulation-displacement means may be associated with any lines whatsoever of the cable. Preferably the two insulation-displacement devices are however associated with the two severed line ends.

The invention is explained in greater detail below by way of example using possible embodiments with reference to the drawings. The combinations of features which differ in the examples of embodiment may be amended and/or combined in any manner whatsoever in accordance with the above statements.

Therein:

Below, for simplicity the same reference numerals are used for elements of the same construction or of the same function.

Figure 1:
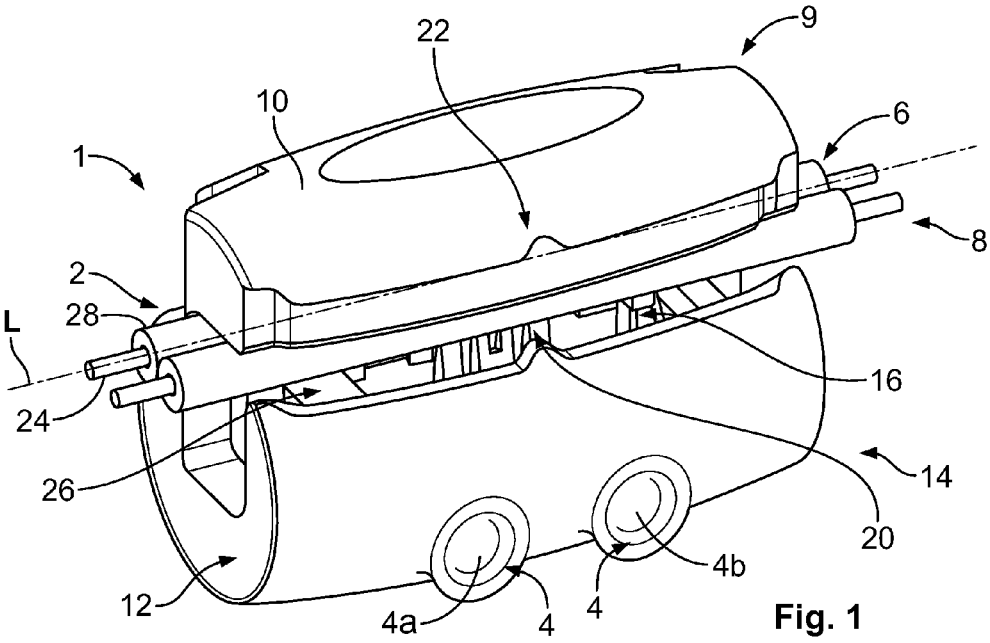
FIG. 1 shows a starting position of an example of embodiment of a connecting terminal according to the invention in a diagrammatic perspective view.

Firstly, the construction and the function of a connecting terminal 1 according to the invention will be explained with reference to FIGS. 1 and 2.

A line receptacle 2 extends, preferably continuously, through the connecting terminal 1 in a direction of the line L.

The connecting terminal 1 further has at least one connector 4—two connectors 4*a* and 4*b* are shown—which can be brought into electrical contact with at least one electric line 6 which is to be severed, which is received in the line receptacle 2. The electric line 6, as FIG. 1 shows, may be part of a cable 8 with a plurality of lines, not all of which have to be severed. Depending on requirements, also a plurality of electric lines 6 of the cable 8 may be severed by the connecting terminal 1.

The connecting terminal 1 can be applied at any point whatsoever on the electric line 6 which is to be severed. For this, a housing 9 is subdivided into two housing shells 10, 12, which in the starting position 14 illustrated in FIG. 1 form between them an insertion opening 16 which extends continuously and over the entire length of the line receptacle 2 in the direction of the line L and opens onto the line receptacle 2. The electric line 6 can be placed in the line receptacle 2 through the insertion opening 16. The line receptacle 2 is formed jointly by the two housing shells 10, 12.

Figure 2:
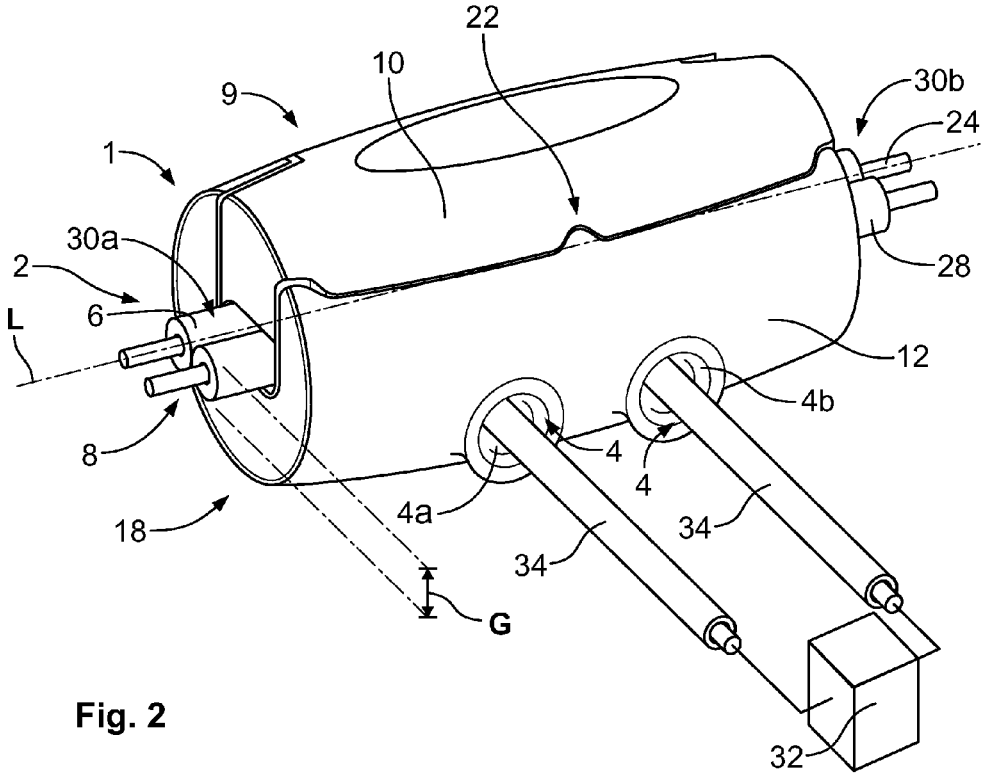
FIG. 2 shows a severing position of the example of embodiment of FIG. 1 in a diagrammatic perspective view.

The two housing shells 10, 12 are movable relative to each other, so that they can be converted from the starting position 14 illustrated in FIG. 1 into the severing position 18 illustrated in FIG. 2. In the severing position, the electric line 6 is severed at one point and the two line ends produced by the severing are isolated from each other. For this, the connecting terminal 1 has a cutting means 20, the construction of which is explained below with reference to FIG. 3.

The position of the severing point in the direction of the line L is marked by a visual marking 22 which can be recognised from outside the housing 9 in the starting position 14 and/or the severing position 18, so that the connecting terminal 1 can be positioned exactly on the electric line 6 which is to be severed.

Additionally, at least one insulation-displacement contact 26 which contacts a conductor 24 of the line 6 is provided in the connecting terminal 1. The insulation-displacement contact 26, upon converting the connecting terminal 1 from the starting position 14 into the severing position 18, automatically contacts the conductor of the electric line 6 through insulation 28 and produces an electrical connection with the at least one connector 4.

In particular, as FIG. 1 shows, two connectors 4*a*, 4*b* may be associated with each electric line 6 which is severed by the cutting means 20. One connector 4*a* is connected to the one severed line end 30*a*, and the other connector 4*b* to the other line end 30*b*, which in the severing position 18 is separated off and isolated from the line end 30*a*. Thus an electric circuit 32 can be connected in series to the severed electric line 6 between the connectors 4*a*, 4*b*. For this, lines 34 are inserted into the connectors 4*a*, 4*b*. The connectors 4*a*, 4*b* are preferably designed such that by simply inserting the not necessarily stripped lines 34 they contact the conductors thereof. The current then flows from the line end 30*a* via the insulation-displacement contact 26 associated with this line end to the connector 4*a*, and thence via the circuit 32 to the connector 4*b* and line end 30*b*.

If the cable 8 has further electric lines, these may extend through the connecting terminal 1 without being severed. Alternatively, also further connectors 4 may be provided which are associated with corresponding severed conductor ends of these electric lines and corresponding insulation-displacement contacts.

Figure 3:
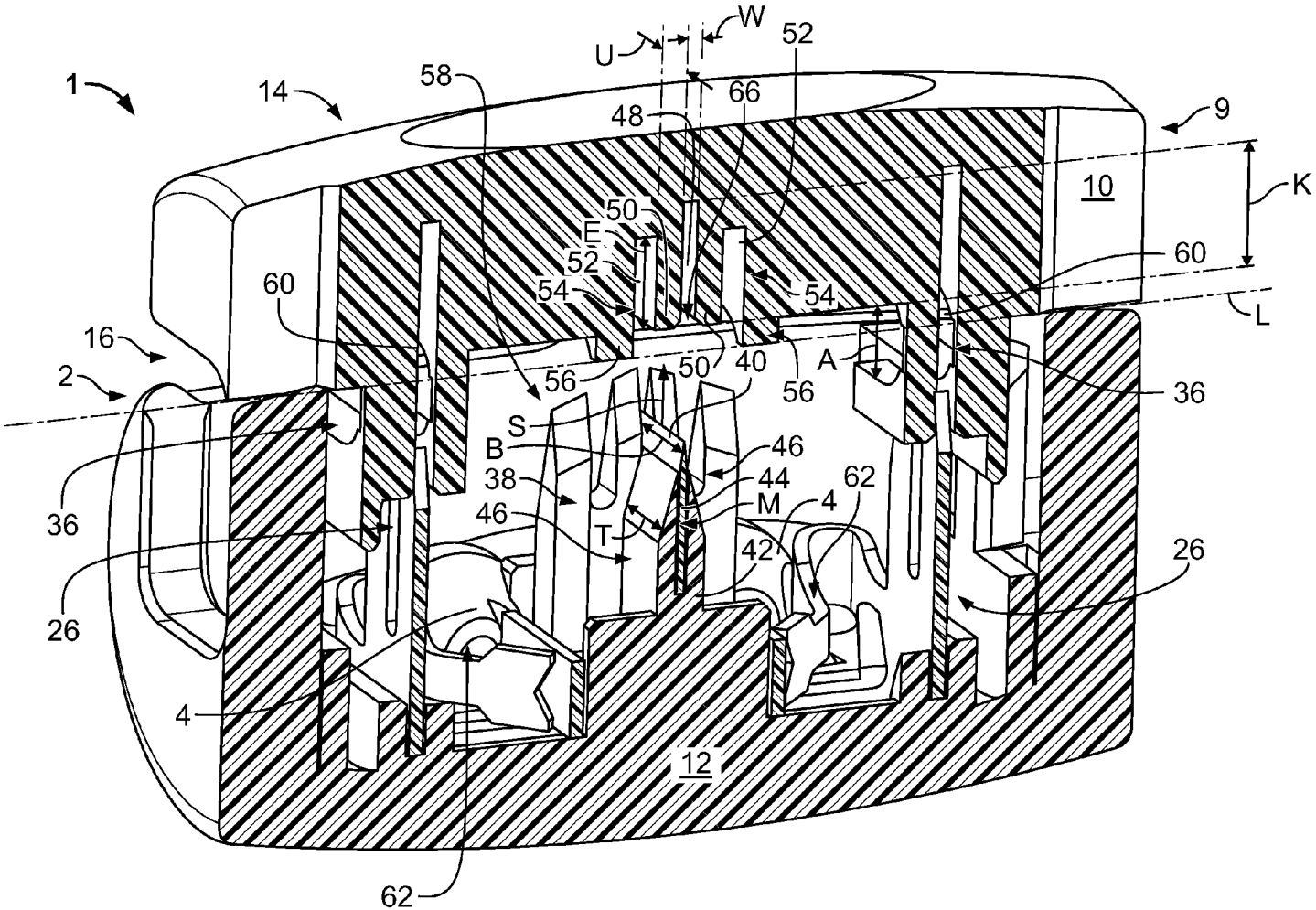
FIG. 3 shows the example of embodiment of FIGS. 1 and 2 in the starting position in a diagrammatic sectional view.

The construction of the cutting means 20 can be seen in FIG. 3, which shows a section in the longitudinal direction L through the starting position 14 illustrated in FIG. 1 viewed in the direction of the insertion opening 16. The electric line 6 which is to be severed or the cable 8 have been omitted in FIG. 3 in order to show the inner construction of the connecting terminal 1. The cutting means 20 is located in the direction of the line L preferably centrally in the region of the line receptacle 2. In order not to hinder the introduction of the electric line 6 or the cable 8, in the starting position 14 the line receptacle 2 is designed as a duct which is continuous in the direction of the line L with an internal width A which corresponds at least to the thickness G of the cable 8 or the electric line 6. The line receptacle 2 preferably has a plurality of line holders 36 which in the starting position 14 open towards the insertion opening 16 and secure the cable 8 or the electric line 6 in the other directions transversely to the direction of the line L. In the example of embodiment of FIG. 3, the line holders 36 are designed in the form of clamps. The line holders 36 in the example of embodiment of FIG. 3 are arranged on both sides of the cutting means 20. If the two housing shells 10, 12 move relative to each other upon the conversion of the connecting terminal 1, the line receptacle 2 with the housing shell 10 which forms it will inevitably also move with them. Upon the conversion from the starting position 14 into the severing position 18, the two housing shells 10, 12 move towards each other and the line receptacle 2 is consequently moved in the direction of the housing shell 12 with the cutting means 20. The cutting means 20 in this case penetrates into the line receptacle 2 and severs the cable 8 or the electric line 6 received therein.

The cutting means 20 has a severing knife 38 for severing the electric line 6, which knife extends along a knife plane M lying transversely to the direction of the line L. A cutting edge 40 of the severing knife 38 faces the line receptacle 2 and extends transversely to the direction of the line L. The breadth B of the cutting edge 40 corresponds to at least the thickness G of the electric line 6 to be severed (FIGS. 1, 2).

The severing knife 38 may be manufactured in one piece from an electrically non-conductive material, for example a ceramic material. For reasons of cost, it is however preferable if the severing knife 38 has a severing base 42 made of electrically non-conductive material, for example plastics material, over which a severing blade 44 projects in the direction of the line receptacle, which blade may then be made of a metallic, electrically conductive material, for example a stamped sheet. The severing base may at the same time serve as a holder for the severing blade 44. As FIG. 3 shows, the severing base 42 tapers towards the severing blade 44. The taper may continue in the cutting edge 40 of the severing blade 44. The transition between the severing base 42 and the severing blade 44 in this case is preferably a smooth one. Steps which are unavoidable merely due to the manufacturing may be present on the side faces 46 of the severing knife 44 which point in the direction of the line. The smooth configuration of the side faces 46 results in low cutting resistances if the transition between the severing blade 44 and the severing base 42 penetrates into the electric line 6 to be severed.

With regard to the conductor receptacle 2, in the cutting direction S, a blade pocket 48 lies opposite the severing knife 38. The blade pocket likewise extends in the knife plane M and has, in the direction transversely to the direction of the line L, an internal breadth U, which corresponds at least to the breadth B of the severing knife 38 in this direction. The blade pocket 48 is open in the direction of the severing knife 38, counter to the cutting direction S. The blade pocket 48 is limited in the direction of the line L by at least one, for example rib-shaped, stripping jaw. In the example of embodiment of FIG. 2, the pocket is limited by stripping jaws 50 on both sides which point in the direction of the line L. The at least one stripping jaw 50 is designed to be preferably elastically deflectable in the direction of the line L away from the blade pocket 48.

Viewed from the blade pocket 48, there is an incision 52 which extends parallel to the knife plane M on either side of the at least one stripping jaw, which incision can be made in the form of a shaft. The depth E of the at least one incision parallel to the knife plane M and in the direction away from the line receptacle 2 may, as FIG. 3 shows, be less than the depth K of the blade pocket 48. The depth E of the incision 52 essentially determines the height H of the stripping jaw 50 associated with the incision 52 over which said jaw can be deflected. The breadth of the incision 52 in the direction of the line L determines the maximum deflection of the stripping jaw 50 in this direction. The stripping jaw 50, upon the conversion into the severing position 18, can only be deflected, widening the blade pocket 48, until it hits against a stop 54.

The blade pocket 48 is located in the direction of the line L between two holding-down means 56, which project relative to the at least one stripping jaw 50 in the direction of the line receptacle 2, but are located at at least the same height as the at least one stripping jaw 50. In the embodiment of FIG. 3, the stop 54 of the at least one stripping jaw 50 is formed by a holding-down means 56.

If the cable 8 comprises a plurality of electric lines which lie next to each other in the region of the line receptacle 2, and only individual electric lines 6 are to be severed by the cutting means 20 (cf. FIGS. 1 and 2), then a separating knife 58 extending substantially along the direction of the line L may be provided at at least one end, located in the direction transversely to the direction of the line, of the severing knife 38, which separating knife may be subdivided into individual cutting edges spaced apart from each other in the longitudinal direction L. The separating knife 58 moves between the electric lines of the cable 8 and separates the electric line 6 which is to be severed from the rest of the electric lines in the region of the severing knife 38. The separation of the electric line 6 to be severed is intended to prevent the possibility of deformations of the electric line 6 occurring during the course of the severing from being transmitted to the adjacent electric lines and resulting in malfunctions there.

Further, the at least one insulation-displacement contact 26 can be seen in FIG. 3, which contact is arranged opposite a receiving gap 60 with respect to the line receptacle 2. In the severing position 18, the insulation-displacement contact is moved into the receiving gap 60. The receiving gap 60 may, as FIG. 3 shows, be arranged between a pair of line holders 36.

The at least one insulation-displacement contact 26 is made from a metallic material, for example in the form of a fork-shaped stamped sheet, and forms in one piece a plug-in contact 62 in the region of the associated connector 4. According to FIG. 3, two insulation-displacement contacts 26 are provided flush on either side of the cutting means 30 in the direction of the line L. The insulation-displacement contacts 26 therefore contact, in the severing position, the two ends of the electric line 6 which are separated from each other by the severing knife 38.

Modifications to this are also possible, by for example associating the insulation-displacement contacts with different electric lines of the cable 8.

The size of the connecting terminal 1 may be selected such that it fits inside a fist and thus the two housing shells 10, 12 can be pressed together manually into the severing position. Of course, smaller or larger housings 9, and also ones which are actuated by ancillary tools, such as for example pincers, are also possible.

If the two housing shells 10, 12 are pressed together, the electric line 6 laid in the line holders 36 or the line receptacle 2 moves in the direction of the housing shell 12 towards the severing knife 38 and, if present, towards the at least one insulation-displacement contact 26 and the at least one separating knife 58. First the at least one separating knife 58 separates the electric line which is to be severed from its neighbouring line or lines. The cutting pressure exerted on the cable 8 by the at least one separating knife 58 is in this case taken up in the region of the cutting means 20 by the holding-down means 56.

During the course of the movement into the severing position, further the at least one insulation-displacement contact 26 penetrates into the receiving gap 60 and pierces and cuts through the insulation of the electric line 6 associated therewith. During the course of the further penetration, the electrical conductor 24 of the line 6 is contacted. The insulation-displacement contact 26 in this case is designed such that the conductors of adjacent electric lines are not contacted.

If the two housing shells are pushed together further, the severing knife 38 gradually cuts through the electric line 6 to be severed, which is supported principally on the holding-down means 56, but may also still be held by the at least one stripping jaw 50. The electric line 6 to be severed often has insulation 28 of great toughness and extensibility, so that it settles around the cutting edge 40 of the severing knife 38, although the cutting edge has already covered the full thickness G of the non-deformed line 6 originally laid in the line receptacle 2. In individual cases, strands of the conductor 24 may also settle over the cutting edge at this point.

In order to cut off this last remainder of the electric line 6 which is to be severed cleanly too and to avoid any short-circuits, the severing knife 38, after passing through the line receptacle or the line thickness G, penetrates into the blade pocket 48. The thickness D of the severing knife 38 in the direction of the line L in the region which penetrates into the blade pocket 48 in this case is greater than the internal width W of the blade pocket 48 in the direction of the line L. This results in deflection of the at least one stripping jaw 50 away from the blade pocket 48 in the direction of the line L. During the course of the deflection, the stripping jaw 50 is supported elastically on the side face 46, associated therewith, of the severing knife 38. The remainder of the electric line 6 to be severed which still extends across the cutting edge 40 is thus clamped between the at least one stripping edge 50 and the side face 46 and fixed close to the cutting edge 40. This means that the last remainder of material is more tightly stretched across the cutting edge 40 and can be severed more easily.

In the final phase of severing, the severed remainder is pulled further between the stripping jaw, which owing to the increasing breadth B of the severing knife is supported increasingly more on the side face 46 associated therewith, away from the cutting edge 40 and possibly from the electrically conductive severing blade 44 on to the severing base 42. The width W of the blade pocket may be calculated such that the cutting edge 40 can still penetrate and the stripping jaw 50 is already deflected before the severing base 42 penetrates. This configuration may however in individual cases result in a very high expenditure of force in converting the connecting terminal 1 into the severing position. In order to reduce this expenditure of force, the internal width W may be increased, so that deflection of the stripping jaw 50 only takes place once the knife 38 has entered deeper into the blade pocket 48. The penetration of the severing knife 38 is made easier if, at least in a run-in region 64 close to its opening 66, the blade pocket 48 widens, being for example made crowned or bevelled.

In the severing position, in the example of embodiment of FIG. 3 the two stripping jaws 50 are deflected by the severing knife 38 on either side of the blade pocket 48 in the longitudinal direction L. The breadth Q of the incisions 52 in the direction of the line L is preferably calculated such that the stripping jaws 50 lie against the respective stops 54 before or if the severing position is reached. The total of the widths Q may correspond in particular to approximately the over-dimension of the severing knife relative to the internal breadth of the blade pocket, so that the at least one stripping jaw 50 is moved right on to the stop 54. This ensures that the last remainders of the line 6 to be severed are also stripped off, since the stripping jaws 50 are considerably more difficult to deflect once they are lying against the stop 54. This means that in this position they reliably wedge in remainders of the line 6 to be severed.

Figure 4:
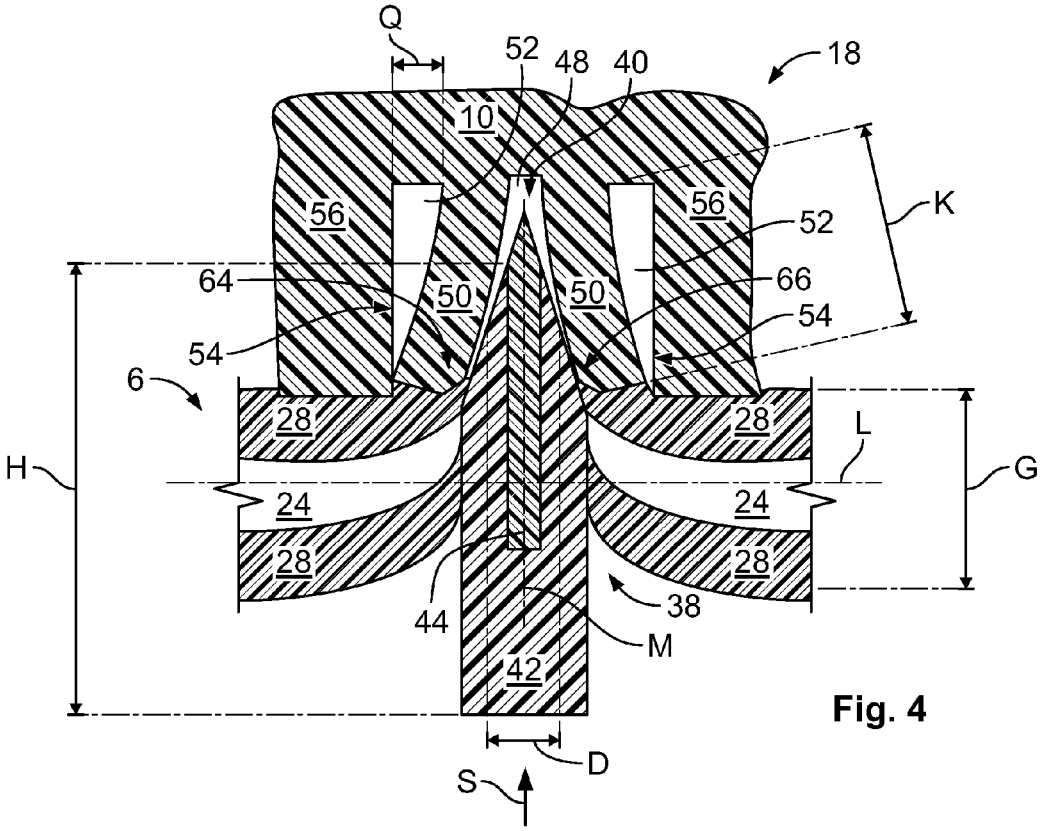
FIG. 4 shows the example of embodiment of FIG. 1 in a diagrammatic sectional view of the severing position.

As FIG. 4 shows, in the severing position the clamping action of the stripping jaws 50 no longer acts on the severing blade 44, but on the severing base 42. This ensures that any remainders of the line 6 to be severed which may still be wedged fast are no longer lying against severing blades 44 which are possibly electrically conductive. In this position, the stripping jaws 50 separate the interior of the blade pocket 48 from the line receptacle 2.

As FIG. 4 furthermore shows, in the severing position the line receptacle 2 is blocked off by the severing knife 38, in particular the severing base 42, so that the two conductor ends 30*a*, 30*b* are completely separated from each other by the severing knife 38 and there is no electrical connection between the two.

Figure 5:
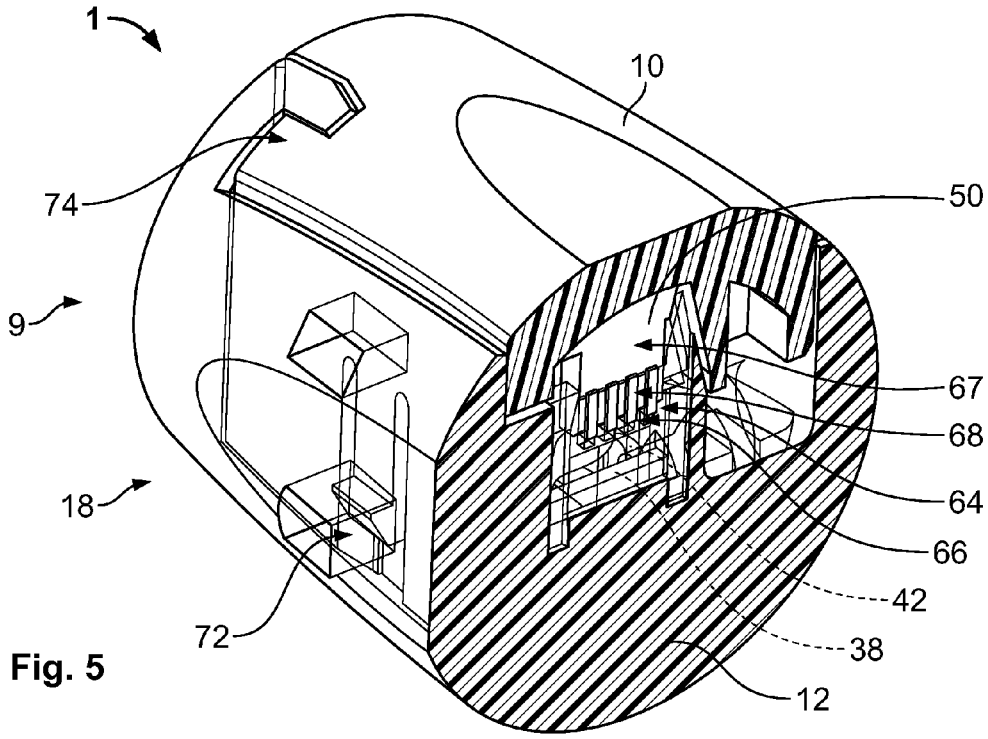
FIG. 5 shows a diagrammatic sectional view of a further example of embodiment of the connecting terminal according to the invention.
Figure 6:
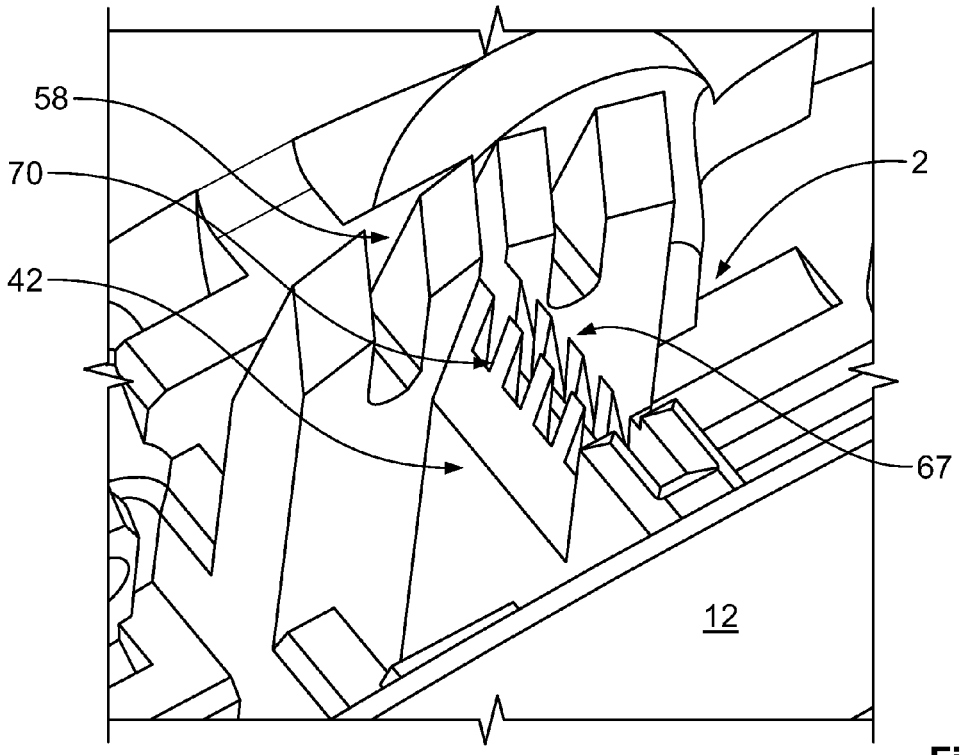
FIG. 6 shows a detail of the example of embodiment of FIG. 5 in a diagrammatic perspective view.
Figure 7:
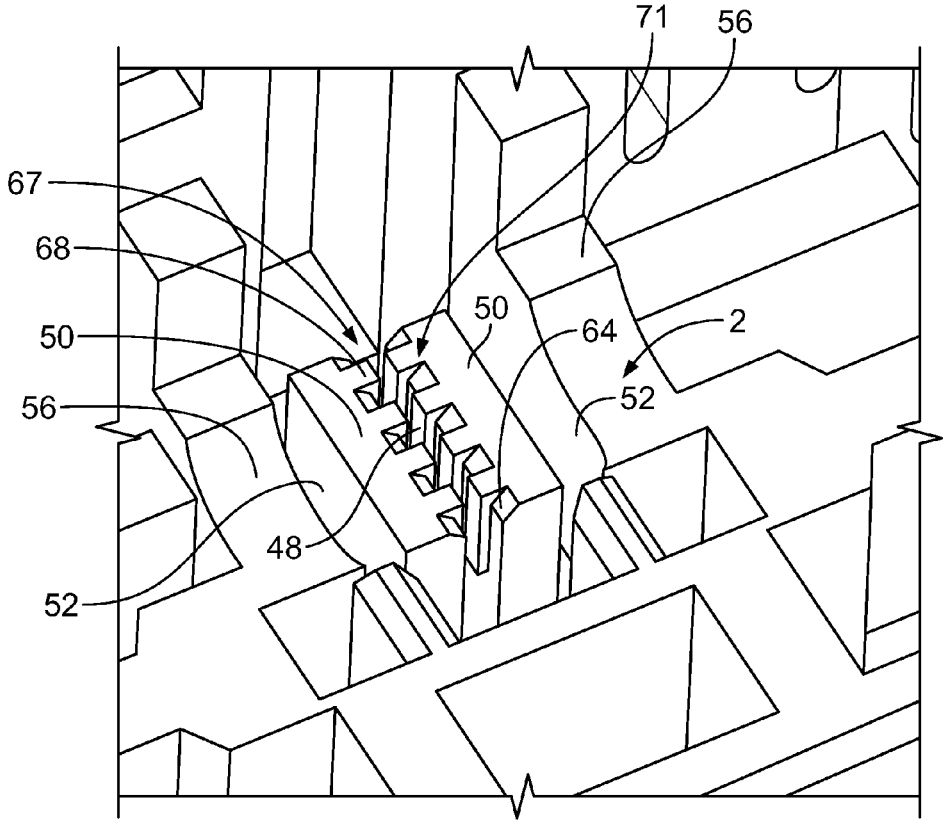
FIG. 7 shows a further detail of the example of embodiment of FIG. 5 in a diagrammatic perspective view.

A further example of embodiment of a connecting terminal according to the invention is shown in FIGS. 5, 6 and 7. The section plane of FIG. 5 is the knife plane M. For brevity, merely the differences from the embodiment of FIGS. 1 to 4 will be discussed.

The example of embodiment of FIG. 5 differs by the configuration of the at least one stripping jaw 50, which is provided with a structure which changes in the direction transversely to the direction of the line L. This structure may, as FIG. 5 shows, have ribs 68 which extend in the cutting direction S and are spaced apart from each other. The severing knife 38, as FIG. 6 shows for the severing base, may have a structure complementary to the structure of the stripping jaw 50 with further ribs 70 which in the severing position are moved between the ribs 68 on the stripping-jaw side. The interleaving of the ribs 68, 70, yields greater rigidity of the stripping jaw and an improved stripping action.

The ribs 70 project in the cutting direction and penetrate into receptacles 71 between the ribs 68 of the at least one stripping jaw 50. The receptacles are provided with a run-in region 64. The housing shells 10, 12 latch in the severing position 18 by means of latch means 72. In FIG. 5 guide elements 74 can also be seen by which the housing shells 10, 12 are guided in the cutting direction S.

The invention claimed is:

1. A connecting terminal for at least one electric line, with a housing, with a line receptacle extending in a direction of the line through the housing and with a cutting means which has a blade pocket extending transversely to the direction of the line and limited in the direction of the line by at least one stripping jaw which is deflectable in the direction of the line, and a severing knife oriented with its cutting edge towards the blade pocket, the severing knife and the blade pocket being arranged to be movable relative to each other from a starting position into a severing position, in which the severing knife at least virtually completely blocks off the line receptacle and is received, at least in sections, in the blade pocket.

2. A connecting terminal according to claim 1, wherein a thickness, in the direction of the line, of the section of the severing knife which projects into the blade pocket in the severing position is greater than an internal width in this direction of the blade pocket in the starting position.

3. A connecting terminal according to claim 1, wherein, in the severing position, the at least one stripping jaw is deflected away from the severing knife in the direction of the line relative to the starting position.

4. A connecting terminal according to claim 1, wherein the blade pocket, on the two sides located in the direction of the line, is limited in each case by at least one stripping jaw which is designed to be deflectable away from the blade pocket in the direction of the line.

5. A connecting terminal according to claim 1, wherein at least one stop for the at least one stripping jaw is provided on the side remote from the blade pocket in the direction of the line, spaced apart from the at least one stripping jaw at least in the starting position.

6. A connecting terminal according to claim 5, wherein the distance between the at least one stop and the at least one stripping jaw corresponds approximately to the excess width or, if at least one stripping jaw in each case is arranged on the two sides of the blade pocket which are located in the direction of the line, corresponds to half of the excess width of the severing knife relative to the blade pocket.

7. A connecting terminal according to claim 1, wherein at least one holding-down means which projects towards the line receptacle is located in the direction of the line spaced apart from the at least one stripping jaw on the side of the line receptacle thereof, which means projects across the stripping jaw towards the line receptacle.

8. A connecting terminal according to claim 5, wherein the at least one stop is located on the at least one holding-down means.

9. A connecting terminal according to claim 1, wherein the severing knife has a severing base made from an electrically non-conductive material and a severing blade projecting over the severing base towards the blade pocket.

10. A connecting terminal according to claim 9, wherein the severing base in the severing position at least virtually completely covers the cross-sectional surface of the line receptacle.

11. A connecting terminal according to claim 9, wherein the height of the severing base transversely to the direction of the line and in the direction of the blade pocket corresponds to at least the internal height of the line receptacle in this direction.

12. A connecting terminal according to claim 9, wherein a breadth of the severing base transversely to the direction of the line and parallel to the blade pocket corresponds to at least the internal breadth of the line receptacle in this direction.

13. A connecting terminal according to claim 9, wherein the severing base projects into the blade pocket in the severing position.

14. A connecting terminal according to claim 9, wherein the severing base tapers towards the blade pocket.

15. A connecting terminal according to claim 1, wherein the blade pocket widens towards the severing knife at least in one run-in region.

16. A connecting terminal according to claim 1, wherein the at least one stripping jaw and the severing knife are provided with complementary structures which change transversely to the direction of the line, which structures engage in one another in the severing position.

17. A connecting terminal according to claim 1, wherein a plurality of stripping jaws lying next to one another transversely to the direction of the line are provided on at least one side of the blade pocket which is located in the direction of the line, which jaws are deflectable independently of each other.

18. A connecting terminal according to claim 1, wherein the housing has at least two housing shells which can be assembled, which together in the starting position form an insertion opening which opens continuously to the line receptacle, and wherein the blade pocket and/or the stripping jaw is attached to the one, and the severing knife to the other, housing shell.

19. A connecting terminal according to claim 18, wherein the housing shells are movable towards each other from the starting position into severing positions and are designed to be able to be latched in the severing position.

20. A connecting terminal according to claim 1, wherein at least one insulation-displacement contact is provided in the direction of the line, spaced apart from the cutting means, which contact is connected in electrically conductive manner to a contact point which is accessible from outside the housing.

* * * * *